United States Patent [19]

Miura

[11] 4,048,542

[45] Sept. 13, 1977

[54] PERMANENT MAGNETS OF DIFFERENT MAGNETIC MATERIALS FOR MAGNETRONS

[75] Inventor: Hiroshi Miura, Tokyo, Japan

[73] Assignee: Tokyo Shibaura Electric Co., Ltd., Kawasaki, Japan

[21] Appl. No.: 678,757

[22] Filed: Apr. 21, 1976

[30] Foreign Application Priority Data

Apr. 25, 1975 Japan ..... 50-50348

[51] Int. Cl.[2] ..... H01J 25/50

[52] U.S. Cl. ..... 315/39.71; 315/39.51; 315/39.75; 315/39.77

[58] Field of Search ..... 315/39.51, 39.71, 39.77, 315/39.75

[56] References Cited

U.S. PATENT DOCUMENTS

| | | | |
|---|---|---|---|
| 3,392,308 | 7/1968 | Cook | 315/39.71 X |
| 3,412,285 | 11/1968 | Gerard | 315/39.77 X |
| 3,454,825 | 7/1969 | Curtis | 315/39.71 |
| 3,843,904 | 10/1974 | Brown | 315/39.71 |
| 3,855,498 | 12/1974 | MacMaster et al. | 315/39.71 |
| 3,984,725 | 10/1976 | Cook et al. | 315/39.71 |

*Primary Examiner*—Saxfield Chatmon, Jr.
*Attorney, Agent, or Firm*—Oblon, Fisher, Spivak, McClelland & Maier

[57] ABSTRACT

A magnetron comprises an anode cylinder, vanes extending from the inner surface of the anode cylinder toward the central axis of the anode cylinder, a cathode disposed at the central axis of the anode cylinder, an output antenna coupled in a high frequency coupling mode to the vanes, and a set of permanent magnets for creating a magnetic field having a line of magnetic force directed toward the axis of the anode cylinder. The set of permanent magnets constitutes a combination of, for example, an alnico magnet and rare earth magnet differing in coercive force.

17 Claims, 17 Drawing Figures

FIG. 8
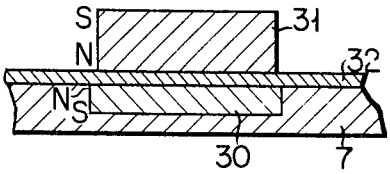
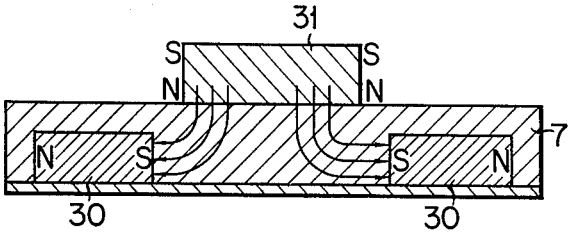
FIG. 9
FIG. 10
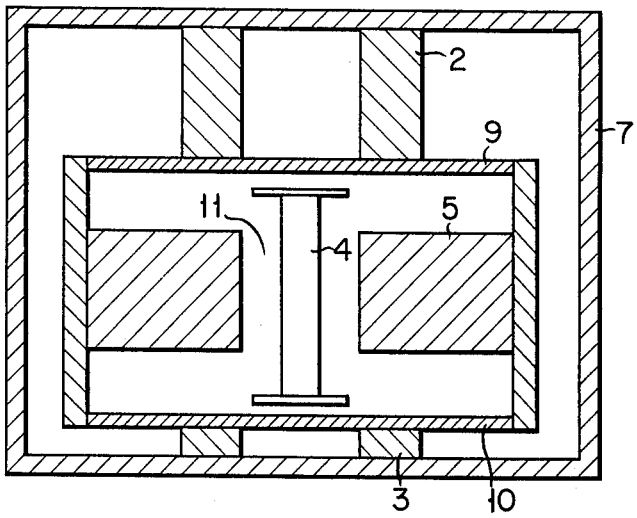
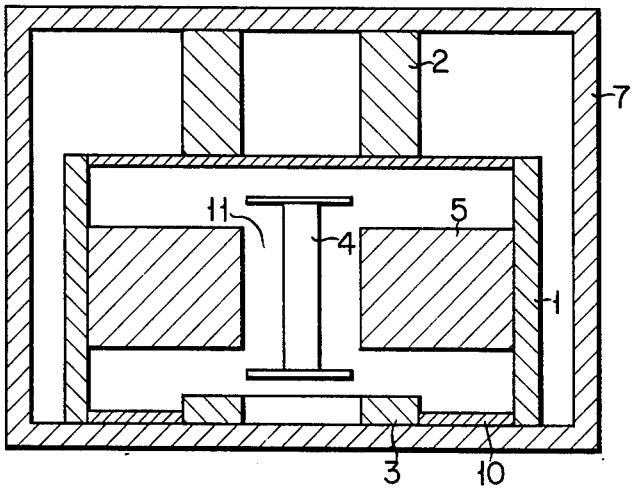
FIG. 11

PERMANENT MAGNETS OF DIFFERENT MAGNETIC MATERIALS FOR MAGNETRONS

BACKGROUND OF THE INVENTION

This invention relates to a magnetron and in particular an improvement in a magnetic device for a magnetron.

Recently a magnetron has been used for quantity-production type microwave ovens etc. and a growing demand is made for a compact and low-cost magnetron. A conventional magnetron, however, can not adquately satisfy design and sales requirements from the standpoint of its characteristic as well as its construction.

A conventionally known magnetron is of an external magnet type in which a magnet device is disposed outside of a case which hermetically seals an anode, cathode etc. Recently, however, an internal magnet type magnetron in which a magnet device hermetically sealing an anode, cathode etc. is disposed outside of the case dominates over the external magnet type magnetron from the miniaturization requirements as well as the ease with which the magnetron is handled.

For the internal magnet type magnetron a permanent magnet should be made compact in size and requires a strong magnetic field. For this reason, a rare earth magnet made of, for example, samarium cobalt or cerium cobalt is generally used instead of a ferrite or alnico magnet. However, the rare earth magnet presents the following various problems.

In the manufacturing process of an ordinary magnetron the rare earth magnet is beforehand strongly magnetized to a value greater than a predetermined value required from the standpoint of an operational characteristic and after the magnetron is operated an output from the magnetron is measured. Then, the slight demagnetization adjustment of the magnet is effected to obtain a desired output. Since the rare earth magnet has a coercive force greater than the ferrite magnet etc., difficulty is encountered in obtaining a predetermined output through the demagnetization adjustment. Furthermore, an expensive large-sized device will be required during the demagnetization adjusting process. The rare earth magnet has more than four times the "energy product" of, for example, the alnico magnet and provides, even in the case of a small magnet, a magnetic field of 1500 to 2000 gauses which is required for a microwave oven magnetron. However, the cost per unit weight of the magnet is high and it is desired that the amount used be reduced to a minimum possible extent. It is because that the use of the rare earth magnet in the magnetron results in high-cost magnetron.

SUMMARY OF THE INVENTION

A primary object of this invention is to provide a magnetron using, as a permanent magnet for a magnet device, a magnet made of magnetic material capable of creating a strong magnetic field at a small volume.

Another object of this invention is to provide a compact magnetron in which a cost performance is prominently improved.

Another object of this invention is to provide a magnetron capable of easily adjusting the field strength of a permanent magnet.

Another object of this invention is to provide a magnetron capable of effecting the magnetization and demagnetization of a permanent magnet so that during an output adjusting process a demagnetization adjustment can be easily carried out.

Another object of this invention is to provide a magnetron capable of effecting, during an output adjusting process, the strong demagnetization adjustment of a permanent magnet without using any large-sized demagnetization adjusting device.

According to this invention there is provided a magnetron comprising an anode in which a resonance cavity is formed, a cathode disposed at the axis of the anode, a magnet device having a set of permanent magnets for creating a magnetic field in a direction substantially vertical to an electric field generated between the cathode and the anode and a yoke magnetically coupled to the permanent magnets, sealing means for hermetically sealing the anode and antenna means for radiating a microwave outside of the magnetron which is generated in the resonance cavity, in which the set of permanent magnets consists of at any combination at least two kinds of magnetic materials differing in coercive force.

Since the permanent magnets of the magnetic device are different in coercive force from each other, a demagnetization adjustment can be easily carried out by the permanent magnet of smaller coercive force. The use of the permanent magnet of greater coercive force permits its volume to be reduced. In consequence, it is possible, according to this invention, to provide a compact magnet equipped magnetron capable of effecting ready magnetization and demagnetization.

BRIEF DESCRIPTION OF THE DRAWING

FIGS. 8 and 9 are cross-sectional views, each, showing a modified form of magnetron different in the embodiment as shown in FIGS. 6 and 7, in which a set of permanent magnets and yoke are arranged in a different way;

FIG. 10 is a cross-sectional view showing a magnetron according to another embodiment of this invention;

FIGS. 11 and 12 are cross-sectional views, each, showing a magnetron according to another embodiment of this invention;

DESCRIPTION OF THE PREFERRED EMBODIMENTS

Figure 1:
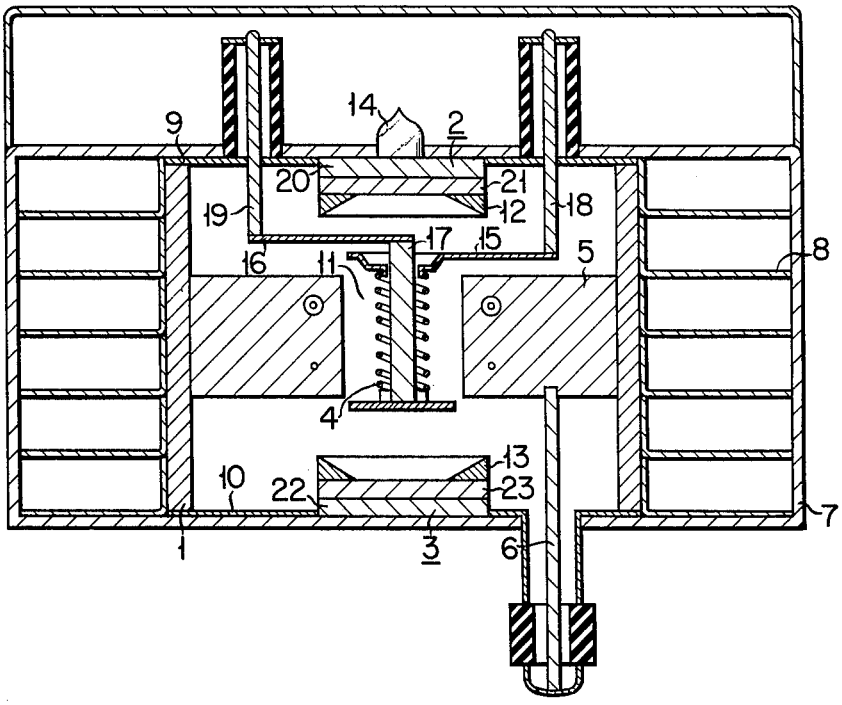
FIG. 1 is a cross-sectional view showing an internal magnet type magnetron according to one embodiment of this invention.
Figure 2:
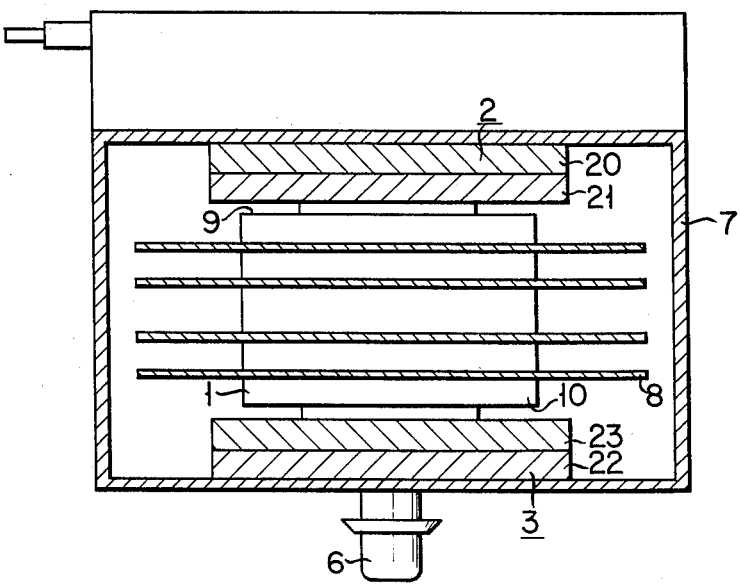
FIG. 2 is a partial cross-sectional view showing an external magnet type magnetron according to another embodiment of this invention.

FIG. 1 shows a magnetron according to one embodiment of this invention in which a pair of magnets are arranged within a cylindrical anode, hereinafter referred to merely as an internal magnet type magnetron, while FIG. 2 shows a magnetron according to another embodiment of this invention in which a pair of magnets are arranged outside of a cylindrical anode, hereinafter referred to merely as an external magnet type magnetron. The internal magnet type magnetron is basically similar in arrangement to the external magnet type magnetron except that in the former type the paired magnets are hermetically sealed within the anode cylinder. The internal magnet type magnetron is subjected to a considerable restriction on the size and properties of a magnet device, from the standpoint of the characteristics and design of the magnetron, as compared with the external magnet type magnetron.

The essential arrangement of the magnetron in FIG. 1 will first be explained below in conjunction with the magnet device which constitutes a major component of this invention.

In the general form of a magnetron a magnetic field is applied in a direction vertical to an electric field to be applied between an anode and a cathode, to produce an oscillating electric field in a resonance cavity, which is extracted as an output from an antenna. The magnetron consists basically of a cathode 4, anode assembly having a cylindrical anode 1 and vanes 5, output means 6, magnet device having a pair of magnets 2, 3 and yoke 7, cooling means 8 and vacuum holding means 9, 10. The anode shown is usually known as a vane type anode structure in which the vanes 5 radially inwardly extends from the inner surface of the anode cylinder 1 toward the central axis of the cylindrical anode 1 and the cathode 4 is located at the central axis of the cylindrical anode. In this anode structure, a voltage is applied from an external drive circuit between the cathode 4 and the vane 5 to create an electric field in a space 11 between the cathode 4 and the vanes 5. A combination of a pole piece 12 and first permanent magnet 2 and a combination of a pole piece 13 and second permanent magnet 3 are disposed one above the space 11 and one below the space 11 so that a magnetic field can be created in the space 11 in a direction vertical to the electric field created between the cathode 4 and the vanes 5. The vacuum holding means, i.e., metal covers 9, 10 are hermetically mounted one at each open end of the anode cylinder 1 to maintain the interior of the anode cylinder 1 in the vacuum state. Each of the permanent magnets 2 and 3 is hermetically fitted in a corresponding opening substantially in the center of the metal covers 9 and 10, and an output antenna 6 is connected to one of the vanes 5. A radiator 8 as the cooling means for the magnetron is provided on the outer periphery of the cylindrical anode 1. On the outer periphery of the radiator 8 is disposed a yoke 7 constituting part of the magnetic device which is magnetically coupled to the first and second permanent magnets 2 and 3. Reference numeral 14 is an exhaust tube for use in exhausting a gas within the space 11. Support plates 15 and 16 are connected to the cathode 4 and a rod for holding the cathode 4 in a predetermined position, and connected to rod-like support 18 and 19, respectively. The support plates 15 and 16 and rod-like supports 18 and 19 serve as lead-in terminals for supplying electric current to the cathode.

In FIG. 2 like reference numerals are employed to designate those parts or elements corresponding to those shown in FIG. 1. Although the interior of the cylindrical anode 1 is not shown in cross section, the cylindrical anode has a construction substantially the same as that shown in FIG. 1. Upon comparison the permanent magnets 2 and 3 in FIG. 1 are different in position from the permanent magnets 2 and 3. That is, FIG. 1 is the magnetron of internal magnet type in which the magnets 2 and 3 are disposed within the cylindrical anode, while FIG. 2 is the magnetron of external magnet type in which the magnets 2 and 3 are disposed outside of the anode cylinder.

According to this invention the magnets 2 and 3 are made of any combination of two kinds of magnetic materials which are different in coercive force from each other. In the manufacture of the magnetron the demagnetization adjustment of the magnetron permanent magnet is effected mainly by a magnetic material of a smaller coercive force. That is, the adjustment of a magnetic field in the space 11 is attained by a magnetic material of a smaller coercive force, i.e., a readily magnetizable and demagnetizable material. In the embodiments shown in FIGS. 1 and 2 the permanent magnet 2 consists of a bonded combination of a disc-like main magnets 21 and auxiliary magnet 20, while the permanent 3 consists of a bonded combination a disc-like main magnet 23 and auxiliary magnet 22. The main magnet is made of a magnetic material of a greater coercive force i.e., a difficulty magnetizable and demagnetizable rare earth compound such as cerium cobalt or samarium cobalt, and the auxiliary magnetic material is made of a magnetic material, such as alnico or ferrite, which is often used as an ordinary permanent magnet. For the internal magnet type magnetron in FIG. 1, a high Curie point alinico is used as the auxiliary magnetic material and, for the external magnet type magnetron in FIG. 1, ferrite, alnico, sheet-like magnet etc. are used as the auxiliary magnet material.

According to this invention the permanent magnet is not formed by only one kind of permanent magnet material and is made of a combination of magnetic materials different in coercive force from each other. The reason for this is that the magnetron per se can be made compact in dimension and that the magnetization and demagnetization of the permanent magnet can be easily effected in the manufacture of the magnetron.

That is to say, an anode voltage Eb at the oscillation of the magnetron is a function of the intensity of a magnetic field in the space 11. When the anode voltage Eb at the oscillation of the magnetron is set to a predetermined value i.e. a predetermined microwave is oscillated from the antenna 6, it is necessary that the permanent magnets 2 and 3 be magnetized to a predetermined value. Usually, the permanent magnets 2 and 3 are preliminarily magnetized to a value greater than a predetermined value and incorporated into a magnetron body. Then, the output of the magnetron is measured during the operative period of the magnetron and the permanent magnet is demagnetized during the inoperative period of the magnetron to obtain a predetermined output. That is, after the demagnetization step a desired value is determined. The reason why the demagnetization step is required in the manufacture of the magnetron is as follows:

When the magnetron is, after assembled, merely operated as it is, there is a fear that the magnetron will not generate a predetermined microwave due to a cumulative error resulting from the assembly errors of the magnetron body, magnetic circuit etc., magnitization error of the magnet device and various errors of parts and components in the magnetron. For this reason, the permanent magnets 2 and 3 are magnetized to a somewhat greater value, thus necessitating the demagnetization step. Viewed from the property of the permanent magnet it is necessarily required that magnetic material for the permanent magnets 2 and 3 be easily magnetized and demagnetized. This is very important when viewed from the property of the permanent magnet for the magnetron. Since in the internal magnet type magnetron the permanent magnets 2 and 3 are provided within the cylindrical anode, it is required that magnetic field not be dissipated or varied due to a temperature. That is to say, a high Curie point is required as the properties of the magnetic material.

Figure 3:
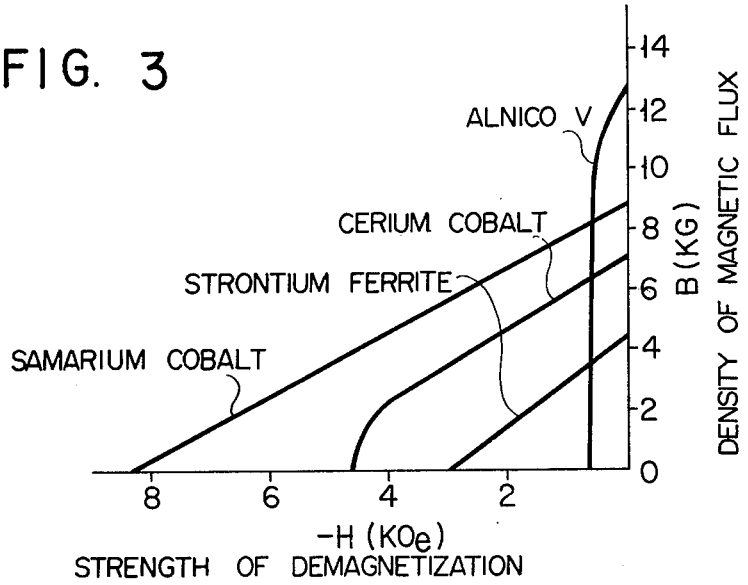
FIG. 3 is a graph showing the demagnetization characteristic of alnico V, stronticeen ferrite and rare earth magnetic material.

As the magnetic material of the magnetron permanent magnet use has been made of alinico, such as alnico V, and ferrite, such as strontium ferrite. Though the alnico and ferrite are excellent in its easily magnetizable and demagnetizable property, their volume and mass can not be reduced to below a certain extent in an attempt to obtain a desired magnetic field strength in the space 11, that is to say, restriction is involved in designing the magnetron per se. In order to obtain a greater magnetic field a ferrite magnet is increased in its disk-like area and an alnico magnet is increased in its column volume. In either case, the magnet is necessarily increased in weight. In order to obtain a desired magnetic field using the ferrite magnet or the alnico magnet, therefore, the magnet can not be reduced in dimension to below a certain extent. For the internal magnet type magnetron in particular, restriction is made on the size of the permanent magnet and the ferrite magnet or alnico magnet is unsuitable in this case. In contrast, a rare earth magnet, even if it is smaller in volume and mass, can provide a desired magnetic field, satisfying a demand for a compact magnetron. For the rare earth magnet, however, a coercive force is very great as shown in FIG. 3 and difficulty is encountered in effecting the magnetization and demagnetization. FIG. 3 graphically shows demagnetization curves for alnico V, strontium ferrite and rare earth compound such as cerium cobalt and samarium cobalt. As will be evident from the graph in FIG. 3 the coercive force Hc is about 0.6 to 0.7 KOe for the alnico and about 3 KOe for the strontium ferrite, whereas the coercive force Hc is about 4.7 KOe for cerium cobalt and about 8.4 KOe for samarium compound. From these it will be understood that a very great coercive force is involved for the rare earth magnet. With these in view this invention uses a permanent magnet consisting of at least two kinds of magnetic materials different in coercive force and demagnetization adjustment is effected by a magnet material of smaller coercive force.

Figure 4:
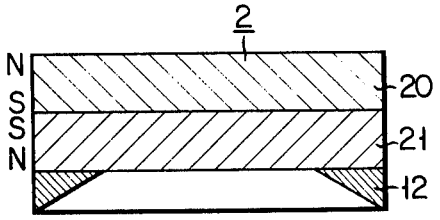
FIGS. 4 and 5 are cross-sectional views, each, schematically showing one of a set of permanent magnets which is different from the permanent magnet in FIG. 1.
Figure 5:
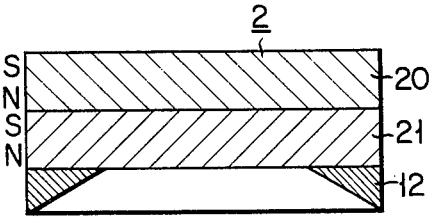

Explanation will now be made of the adjustment of a magnetic field intensity in the magnetron according to one embodiment of this invention. FIGS. 4 and 5 schematically show a permanent magnet 2 and pole piece 12 for convenience of explanation.

Explanation will now be made of the case where with the magnetron in the "oscillated" condition an output of the magnetron is measured followed by the demagnetization adjustment of the permanent magnet. The permanent magnet comprises a main magnet 21 and auxiliary magnet 20 so combined that they are magnetized in the same direction, the main and auxiliary magnets being different in the kind of materials from each other. After the permanent magnet is incorporated into the magnetron the magnetron is operated to generate an output and the demagnetization adjustment follows the measurement of the output. The previously strongly magnetized main magnet 21 made of, for example, a rare earth compound is hard to demagnetize due to a great coercive force, but the auxiliary magnet made of, for example, alnico can be readily demagnetized due to a smaller coercive force, making it possible to make the permanent magnet 2 at a suitable value. Since the permanent magnet 2 is beforehand strongly magnetized, the permanent magnet is demagnetized in a direction opposite to that in which it is magnetized. The demagnetization adjustment can be carried out so that the opposite pole surfaces of the main and auxiliary magnets face each other as shown in FIG. 5 or the demagnetization adjustment is more strongly effected as shown in FIG. 4 so that the same pole surfaces (the south pole surfaces in this case) of the main and auxiliary magnets confront each other.

Suppose, for example, that the permanent magnet 2 is beforehand strongly magnetized so that the oscillation anode voltage of the magnetron is 4.2 to 4.5 KV. If in this case demagnetization adjustment is effected so that the oscillation anode voltage of the magnetron becomes 4.0 KV, the volume or magnetic field strength of the auxiliary magnet 20, though different in the magnetic material used, is about 5 to 15% based on the whole weight of the main magnet 21.

Further embodiments of this invention will now be explained using FIGS. 6 to 9.

Figure 6:
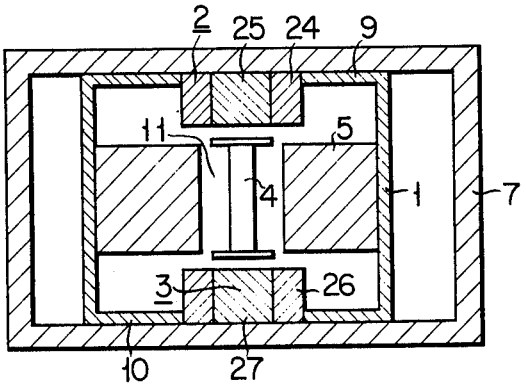
FIGS. 6 and 7 are cross-sectional views, each, showing a magnetron according to another embodiment of this invention.

FIG. 6 shows a magnetron using permanent magnets 2 and 3, the former comprising a cylindrical main magnet 25 and a ring-like auxiliary magnet 24 coaxially and integrally fitted over the main magnet 25 and the latter comprising a cylindrical main magnet 27 and a ring-like auxiliary magnet coaxially and integrally fitted over the main magnet 24. Although the FIG. is schematically shown on the drawing for convenience of explanation, the structure is basically the same with that in FIG. 1. The magnetron is of an internal magnet type and it will be understood that the paired permanent magnets in FIG. 6 can be applied to the external magnet type magnetron in FIG. 2. In this case, the ring-like auxiliary magnets 24 and 26 are made of an alnico magnet etc. which have a smaller coercive force i.e. are readily damagnetizable, and the cylindrical main magnets 25 and 27 are made of a rare earth magnet which has a greater coercive force i.e. are difficulty demagnetizable.

Figure 7:
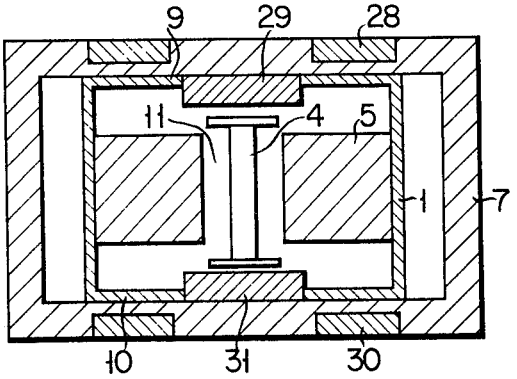

FIG. 7 shows a magnetron in which a plurality of auxiliary magnets 28, 30 are embedded in proper places in a yoke 7 and a proper magnetic field can be created in a space 11 between a cathode 4 and vanes 5 on a cylindrical anode. This magnetron is of an internal magnet type and it will be understood that it can be applied to the external magnet type magnetron. The yoke 7 is thicker than a yoke usually used for the magnetron and in this embodiment the plurality of auxiliary magnets 28 and 30 are so embedded in the yoke 7 as to surround the main magnets 29 and 31, respectively. It is not necessary that the yoke 7 be made thick over the entire length thereof and it will be sufficient if the yoke is made thick only at a location where the auxiliary magnet is embedded. As shown in FIG. 8 the main magnet 31 may be formed above the auxiliary magnet 30 embedded in the yoke 7. The position and magnetization direction of the main and auxiliary magnets 31 and 30 can be combined in a variety of ways. As shown in FIG. 8, for example, the main and auxiliary magnets 31 and 30 are so arranged that the same pole surfaces (the north pole in this case) confronts each other. A plurality of auxiliary magnets 30 can be so arranged as to generate magnetic fluxes which are directed in the same direction as that in which the magnetic flux of the main magnet 31 is directed. It will be evident that the main and auxiliary magnets can take any other position. The main magnet 31 is made of a rare earth magnet having a greater coercive force and the auxiliary magnet 30 is made of alnico or ferrite having a smaller coercive force.

Figure 12:
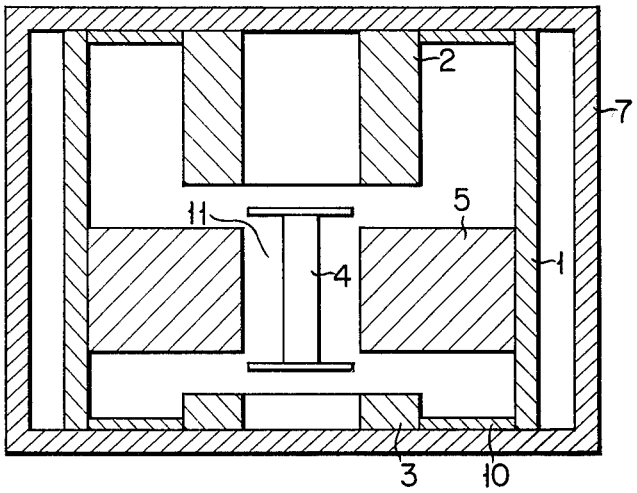

Explanation will be made of magnetrons having a magnetic circuit capable of readily being demagnetized, i.e., a magnetic circuit which requires no particular strong demagnetization adjusting device. These embodiments as shown in FIGS. 10 to 12 are fundamentally the same in concept with the above-mentioned embodiments.

FIG. 10 shows the magnetron schematically shown for convenience of explanation. This magnetron is of an external magnet type and is substantially similar in structure to the magnetron in FIG. 2 except that permanent magnets 2 and 3 are arranged in a different way. Identical reference numerals are employed in the embodiments in FIGS. 10 to 12 to designate parts or elements corresponding to those shown in FIGS. 1 and 2. The permanent magnets 2 and 3 are in the form of a ring and they are made of magnetic materials different in coercive force from each other. That is to say, a first permanent magnet 2 is made of a magnetic material such as alnico or ferrite and a second permanent magnet is made of a rare earth magnetic material. The magnetron shown has strongly magnetized permanent magnets 2 and 3 incorporated therein and the demagnetization adjustment of the first permanent magnet 2 is effected primarily by a demagnetization adjusting device. That is, the first permanent magnet 2 can be readily demagnetized, as already described in connection with the above mentioned embodiment, due to its smaller coercive force.

FIG. 11 shows a modified form of the embodiment in FIG. 10, in which one permanent magnet 3 is disposed in a space in a cylindrical anode 2. The magnetron in FIG. 11, though not of a typical internal magnet type, belongs to a modified form of magnetron. A variety of magnetic materials can be suitably used for the permanent magnet 2, which is disposed outside of the cylindrical anode 2, without paying a considerable attention to a Curie point. That is, for the internal magnet type magnetron a temperature within the cylindrical anode 1 is raised during the operation of the magnetron and a high Curie point is required for the magnetic material of the permanent magnet. As a result, restriction is made on the material for the permanent magnet. FIG. 12 shows a modified form of the magnetron in FIG. 10. The magnetron in FIG. 12 is of a typical internal magnet type and permanent magnets 2 and 3 are hermetically sealed in a cylindrical anode. In the magnetrons as shown in FIGS. 11 and 12 the first permanent magnet 2 is ferrite or alnico magnet and the second permanent magnet 3 is a rare earth magnet. As the first permanent magnet 2 shown in FIG. 12 it is preferable to use an alnico magnet higher in Curie point than a ferrite magnet.

The magnetization and demagnetization adjusting steps of the magnetron will now be described more in detail below by referring to FIGS. 13 and 14.

Figure 13:
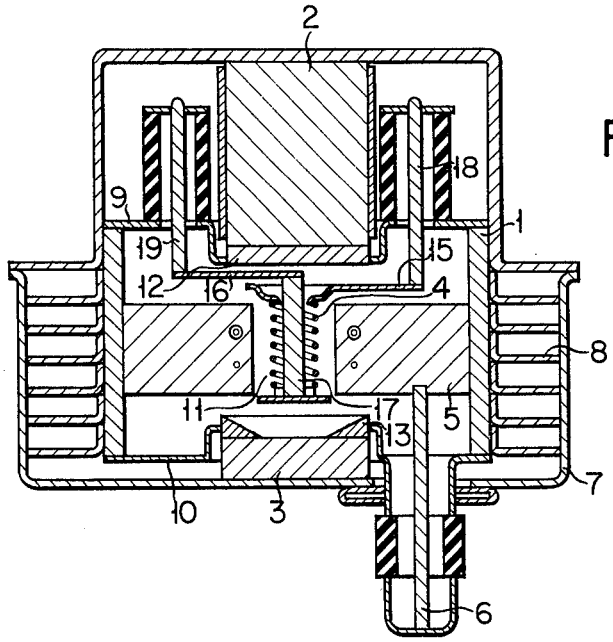
FIG. 13 is a cross-sectional view showing the magnetron in FIG. 10 more in detail.

A magnetron in FIG. 13 is substantially similar in construction to that in FIG. 12 and is shown more in detail. Identical reference numerals are employed to designate parts or elements corresponding to those shown in FIGS. 1 to 12.

As shown in FIG. 13, a pair of permanent magnets 2 and 3 are different in volume from each other.

That is, the permanent magnet 3 is smaller than the permanent magnet 2, because the former is made of a magnetic material of a great coercive force and the latter a magnetic material of smaller coercive force. An output conductor 6 is connected to the vane 5 and extends parallel to the axis of the anode cylinder and in the neighborhood of the permanent magnet 3. The rod-like supports 18 and 19 are connected to the cathode 4 and rod 17 in proximity to the permanent magnet 2 and extend parallel to the axis of the anode cylinder. Since the output conductor 6 is disposed close to the thin permanent magnet 3, there is no necessity for the conductor 6 to be lengthened to an unnecessary extent. The conductor 6 to be projected from the bottom of the magnetron can be sufficiently shortened owing to a relatively small thickness of the permanent magnet 3, thus making the magnetron properly compact in size.

The magnetization and demagnetization of the permanent magnets 2 and 3 are usually effected after the magnetron is assembled. According to this invention, the rare earth magnet 3 and alnico magnet 2 are separately magnetized and demagnetized. That is, the previously magnetized rare earth magnet 3 is demagnetized, without being mounted on the magnetron, to have a predetermined field strength and, after being mounted together with the alnico magnet 2 on the magnetron, the alnico magnet 2 is magnetized and then demagnetized. Such a demagnetization adjusting step are effected for the reason set out below.

Figure 14:
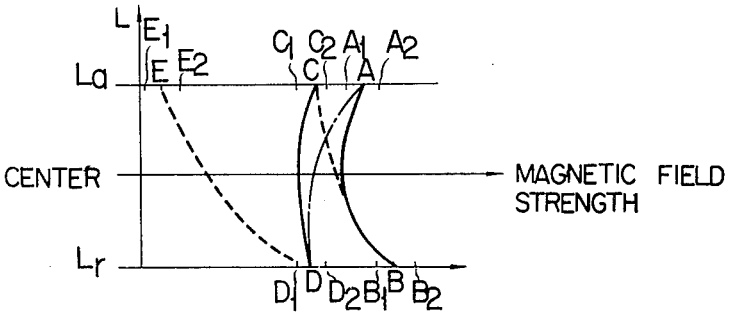
FIG. 14 is a graph showing a relation of a magnetic field strength between a set of permanent magnets to a position between the set of the permanent magnets in magnetizing and demagnetizing process.

FIG. 14 is a graph showing the characteristic of a magnetic field intensity in the magnetron in FIG. 13. In the graph shown in FIG. 14. L on the ordinate axis represents a position in the central axis of the magnetron, La represents the surface position of a pole piece 12 mounted on the alnico magnet 2, and Lr represents the surface position of a pole piece 13 mounted on the rare earth magnet 3. The abscissa plots a field strength in each position in a space 11 between a cathode and vanes 5.

Explanation will now be made of the magnetization and demagnetization steps of a magnetron in which the rare earth magnet 3 and alnico magnet 2 are incorporated.

In the magnetization step a field strength on the surface position La of the pole piece 12 of the alnico magnet 2 is in a value range of A1 and A2 and a field strength on the surface position Lr of the pole piece 13 of the rare earth magnet 3 is in a value range of B1 to B2. The selection of these average values results in a solid line AB and the permanent magnets 2 and 3 in the magnetron are magnetized to a proper value. In the demagnetization step effected after an oscillation wavelength is measured, however, an average field strength in the space 11 results in a dotted curve ED or CB, i.e. an unbalanced distribution. If the rare earth magnet 3 is demagnetized by applying a greater magnetic field so that a field strength on the surface position Lr of the pole piece 13 on the rare earth magnet 3 is shifted from a value B to a value range between D1 and D2, the alnico magnet 2 of smaller coercive force is either demagnetized to a value range of E1 to E2 of demagnetized so that the polarity is reversed, the field strength is eventually distributed as indicated by a dotted line ED. When the alnico magnet 2 is demagnetized to a value range of C1 to C2, the rare earth magnet 3 is hardly demagnetized and, in consequence, the field intensity is distributed as indicated by a dotted curve CB. When an unbalanced field strength occurs in the space 11 as indicated by the curve CB or ED, the magnetron is not properly operated. According to this invention, before the rare earth magnet 3 is incorporated into the magnetron, the rare earth 3 is magnetized and then demagnetized to a value range of D1 to D2. After the rare earth magnet 3 is incorporated together with the alnico magnet 2 into the magnetron body, the alnico magnet 2 is magnetized.

Since the rare earth magnet 3 has a greater coercive force, it is not influenced by the magnetization step of the alnico magnet 2 at that time. By the magnetization of the alnico magnet 2 the field strength in the space 11 is distributed as indicated by a dot-dash line AD. When the alnico magnet 2 is demagnetized, the field strength in the space 11 is distributed as indicated in a solid line CD and a proper magnetic field is established in the space 11. In the demagnetization step of the alnico magnet 2 the rare earth magnet 3 is not demagnetized due to its greater coercive force.

If the above-mentioned magnetization and demagnetization steps are adopted, the rare magnet 3 is magnetized and demagnetized in a single form. In consequence, a relatively small excitation coil can be used in the magnetization and demagnetization steps and a small power source equipment can be used in this case. That is, the alnico magnet 2 can be magnetized and demagnetized using conventional small-sized devices. According to this invention, therefore, simple and small-sized magnetizing and demagnetizing devices can be employed in the magnetizing and demagnetizing steps.

This invention can provide a magnetron which is simple in construction, low in cost and easy to adjust a field strength. It is also possible according to this invention to provide a magnetron which can effect very easy demagnetization adjustment without the necessity of using any powerful demagnetizing device.

What is claimed is:

1. A magnetron comprising:

an anode in which resonance cavities are defined, a cathode disposed at the axis of the anode, a pair of permanent magnets creating a magnetic field in a direction substantially vertical to an electric field produced between the anode and cathode, one of the permanent magnets being made and readily magnetizable and demagnetizable magnetic material and the other being made of difficultly magnetizable and demagnetizable magnetic material having a larger coercive force than that of the magnetic material of the said one of the permanent magnets, a yoke magnetically coupled to the pair of permanent magnets, and sealing means for hermetically sealing the anode.

2. The magnetron according to claim 1 wherein the pair of permanent magnets are disposed outside the sealing means.

3. The magnetron according to claim 1 wherein either one of the pair of permanent magnets is disposed outside the sealing means and the other is disposed in the sealing means.

4. A vane-type magnetron comprising:

an anode having an anode cylinder and vanes extending from the inner suface of the anode cylinder toward the axis of the anode cylinder to define resonance cavities within the anode cylinder, a pair of permanent magnets disposed at both opening ends of the anode cylinder, respectively and in alignment with the axis of the anode cylinder to create a magnetic field in a direction substantially vertical to an electric field created between the vane and the cathode and in a direction transverse to the axis of the anode cylinder, one of the permanent magnets being made of readily magnetizable and demagnetizable magnetic material and the other being made of difficultly magnetizable and demagnetizable magnetic material having a larger coercive force than that of the magnetic material of the said one of the permanent magnets, a yoke extending outside the anode cylinder and magnetically coupled to the pair of permanent magnets, and sealing means for hermetically sealing the anode.

5. The vane-type magnetron according to claim 4 wherein the sealing means comprises covers for covering both open ends of the anode cylinder and the permanent magnets are disposed opposite to the corresponding covers and outside the anode cylinder.

6. The vane-type magnetron according to claim 4 wherein the sealing means comprises covers for covering both open ends of the anode cylinder and one of the pair of permanent magnets is disposed within the anode cylinder which is hermetically sealed by the covers and the other permanent magnet is disposed outside the anode cylinder.

7. The vane-type magnetron according to claim 4 wherein the sealing means comprises covers for covering both open ends of the anode cylinder and the pair of permanent magnets are disposed within the anode cylinder and are hermetically sealed by the cover within the anode cylinder.

8. The vane-type magnetron according to claim 4 wherein the said one permanent magnet disposed within the anode cylinder comprises a magnetic material having a high Curie point.

9. The vane-type magnetron according to claim 4 wherein the readily magnetizable and demagnetizable permanent magnet comprises alnico magnetic material.

10. The vane-type magnetron according to claim 4 wherein the other difficultly magnetizable and demagnetizable permanent magnet comprises rare earth magnetic material.

11. The vane-type magnetron according to claim 4 wherein at least one of the pair of permanent magnets is a solid cylinder.

12. The vane-type magnetron according to claim 4 wherein at least one of the pair of permanent magnets is a hollow cylinder.

13. The vane-type magnetron according to claim 4 further comprising an output antenna connected to the vane and extending parallel to the axis of the anode cylinder and in proximity to the said one permanent magnet of larger coercive force.

14. The vane-type magnetron according to claim 4 further comprising a cathode stem connected to the cathode and extending parallel to the axis of the anode cylinder and in proximity to the said one permanent magnet of smaller coercive force.

15. The vane-type magnetron according to claim 4 further comprising a concave piece mounted on at least one of the pair of permanent magnets in opposed relation to the electric field.

16. The vane-type magnetron according to claim 15 wherein the pole piece has a ring-like shape.

17. A method for manufacturing a magnetron comprising an anode in which resonance cavities are defined, a cathode disposed at the axis of the anode, a pair of permanent magnets creating a magnetic field in a direction substantially vertical to an electric field produced between the anode and cathode, one of the permanent magnets being made of readily magnetizable and demagnetizable magnetic material and the other being made of difficultly magnetizable and demagnetizable magnetic material having a larger coercive force than that of the magnetic material of the said one of the permanent magnets, a yoke magnetically coupled to the pair of permanent magnets, and sealing means for hermetically sealing the anode, the method comprising:

magnetizing the said other permanent magnet of difficultly magnetizable and demagnetizable magnetic material before it is incorporated into a magnetron;

magnetizing the said one permanent magnet after it is incorporated into the magnetron together with the said other permanent magnet; and adjustably demagnetizing the said one permanent magnet by a magnetic field of an intensity as not to cause demagnetization of the said other permanent magnet to create a predetermined magnetic field in a space between the anode and the cathode.

* * * * *